US007533529B2

(12) United States Patent
Stilgenbauer

(10) Patent No.: US 7,533,529 B2
(45) **Date of Patent: *May 19, 2009**

(54) TURBOCHARGER AND VANE SUPPORT RING FOR IT

(75) Inventor: Michael Stilgenbauer, Bolanden (DE)

(73) Assignee: BorgWarner Inc., Auburn Hills, MI (US)

( * ) Notice: Subject to any disclaimer, the term of this patent is extended or adjusted under 35 U.S.C. 154(b) by 167 days.

This patent is subject to a terminal disclaimer.

(21) Appl. No.: 11/270,738

(22) Filed: Nov. 9, 2005

(65) Prior Publication Data

US 2006/0053787 A1 Mar. 16, 2006

Related U.S. Application Data

(63) Continuation of application No. 10/649,477, filed on Aug. 26, 2003, now Pat. No. 7,010,915.

(30) Foreign Application Priority Data

Aug. 26, 2002 (EP) ..... 02018296

(51) Int. Cl.
*F02D 23/00* (2006.01)
*F01B 25/02* (2006.01)
*F01D 17/16* (2006.01)
*F01D 17/12* (2006.01)

(52) U.S. Cl. ..... 60/602; 415/160; 415/163; 415/164; 415/166

(58) Field of Classification Search ..... 60/602; 415/160, 163–164, 166
See application file for complete search history.

(56) References Cited

U.S. PATENT DOCUMENTS 3,232,581 A * 2/1966 Swearingen ..... 415/163
3,326,522 A * 6/1967 Pickering ..... 415/163
4,504,190 A * 3/1985 Beeloo ..... 415/166
4,659,295 A * 4/1987 Burdette et al. ..... 415/164
4,679,984 A * 7/1987 Swihart et al. ..... 415/164
4,702,672 A * 10/1987 Leicht et al. ..... 415/164
4,804,316 A * 2/1989 Fleury ..... 415/164
5,207,565 A * 5/1993 Roessler ..... 417/407
6,558,117 B1 * 5/2003 Fukaya et al. ..... 415/164
6,779,971 B2 * 8/2004 Garrett ..... 415/160
7,114,919 B2 * 10/2006 Scholz et al. ..... 415/164

(Continued)

FOREIGN PATENT DOCUMENTS

FR 1442174 * 5/1966 ..... 415/164

(Continued)

*Primary Examiner*—Thai-Ba Trieu
(74) *Attorney, Agent, or Firm*—Williamson Anderson; Stephan A. Pendorf; Patent Central LLC

(57) ABSTRACT

A turbocharger comprising a turbine housing where at least one supply channel supplies an exhaust gas. The exhaust gas is fed through a guide grid that forms passages of variable cross-section between the supply channel and a turbine rotor. This guide grid comprises a plurality of vanes of predetermined width in a vane space of about the same width. A vane support ring defines one axial end of the annular vane space and an opposite ring is spaced from the vane support ring by about the width of the vanes to define the other axial end of the annular vane space. To maintain this width, at least two spacers are integrally formed on at least one the rings.

14 Claims, 3 Drawing Sheets

U.S. PATENT DOCUMENTS

| | | | | |
|---|---|---|---|---|
| 7,189,058 | B2 * | 3/2007 | Metz et al. | 415/165 |
| 2003/0170117 | A1 * | 9/2003 | Knauer et al. | 415/160 |
| 2004/0081567 | A1 * | 4/2004 | Boening | 417/406 |
| 2006/0112690 | A1 * | 6/2006 | Hemer | 60/602 |

FOREIGN PATENT DOCUMENTS

| | | | |
|---|---|---|---|
| GB | 701557 | * | 12/1953 |

* cited by examiner

TURBOCHARGER AND VANE SUPPORT RING FOR IT

CROSS REFERENCE TO RELATED APPLICATION

This application is a continuation of U.S. application Ser. No. 10/649,477 filed Aug. 26, 2003, now U.S. Pat. No. 7,010, 915 allowed Oct. 7, 2005, which was based upon European Patent Application No. 02 018 296.0, filed Aug. 26, 2002, from which priority is claimed.

TECHNICAL FIELD

This invention relates to a turbocharger in whose turbine housing at least one turbine rotor is rotatably supported. The turbine rotor is supplied with an exhaust gas which is typically emitted from a combustion motor. Supply of exhaust gas is effected through a supply channel in the turbine housing and a ring of guide vanes (or guiding grid) of a variable turbine geometry, as is understood in the prior art, for example according to WO 01/96713, to form nozzles of variable orientation between each pair of vanes for supplying the exhaust gas in an adjustable amount to the turbine rotor. Therefore, the guiding grid comprises a vane support ring which defines and delimits the vane space at one axial end and which supports pivoting shafts of a plurality of the above-mentioned vanes arranged around the turbine rotor, the amount of exhaust gas supplied to the rotor being adjusted by pivoting the vanes by means of their shafts. At the opposite axial end of the vane space is a further ring (TG) which defines and delimits this space so that the axial width of this space corresponds approximately to the width of the vanes (or is larger by a small tolerance).

The invention relates furthermore to a vane support ring formed in the above-mentioned manner. It should be noted that, in the context of this specification, the term "turbocharger" should be understood in its broadest sense as to encompass also other, similar, fluid flow engines, such as secondary air pumps.

BACKGROUND OF THE INVENTION

A turbocharger of this type and such a vane support ring have been disclosed, for example, in EP-A-0 226 444. In this known construction, the width of the vane space, i.e. the axial dimension of this space is ensured by spacing distance bushings to be fastened to the vane support ring by screws. This, of course, is troublesome and expensive when mounting and assembling.

SUMMARY THE INVENTION

It is an object of the present invention to reduce the production costs of a turbocharger or a vane support ring of the type described.

According to the invention, this object is achieved by forming spacers distributed over the circumference of at least one of those rings which define the axial ends of the vane space so as to be integral with it or them.

It is surprising that in this way not only the above-mentioned object is achieved, but also precision and reliability of operation are enhanced, as will be become apparent from the following detailed description of the drawings.

In principle, it would not matter whether the spacers are integrally formed with one or the other rings or alternately on one and then the other ring or on both rings aligned, but being of half the axial length of the space width. However, it is preferred that the spacers are integrally formed with said vane support ring. This could be done by embedding them into the material of the ring (or machined out of the ring's material), but preferably the spacers are cast together with the ring, particularly by a precision casting process. The reason is that the other ring may, in many cases, form part of a larger component of the turbine housing so that forming the spacers integrally with this ring would be more difficult.

In this way, according to the invention, by forming the spacers integrally, mounting work and expenses are avoided. If a precision casting process is applied, tolerances can be reduced so that this method of manufacturing the ring(s) and spacers results in a higher overall precision. As to the construction, one is free to choose an aerodynamically favorable shape instead of the cylinder shape of distance bushings, as in the prior art. In a preferred embodiment, this may be done such that the spacers are themselves in the shape of a vane. Such an elongated shape could, preferably, be oriented approximately in tangential direction with respect to the ring.

BRIEF DESCRIPTION OF THE DRAWINGS

Further details will become apparent from the following description of a preferred embodiment schematically shown in the drawings in which.

DETAILED DESCRIPTION OF THE INVENTION

Figure 1:
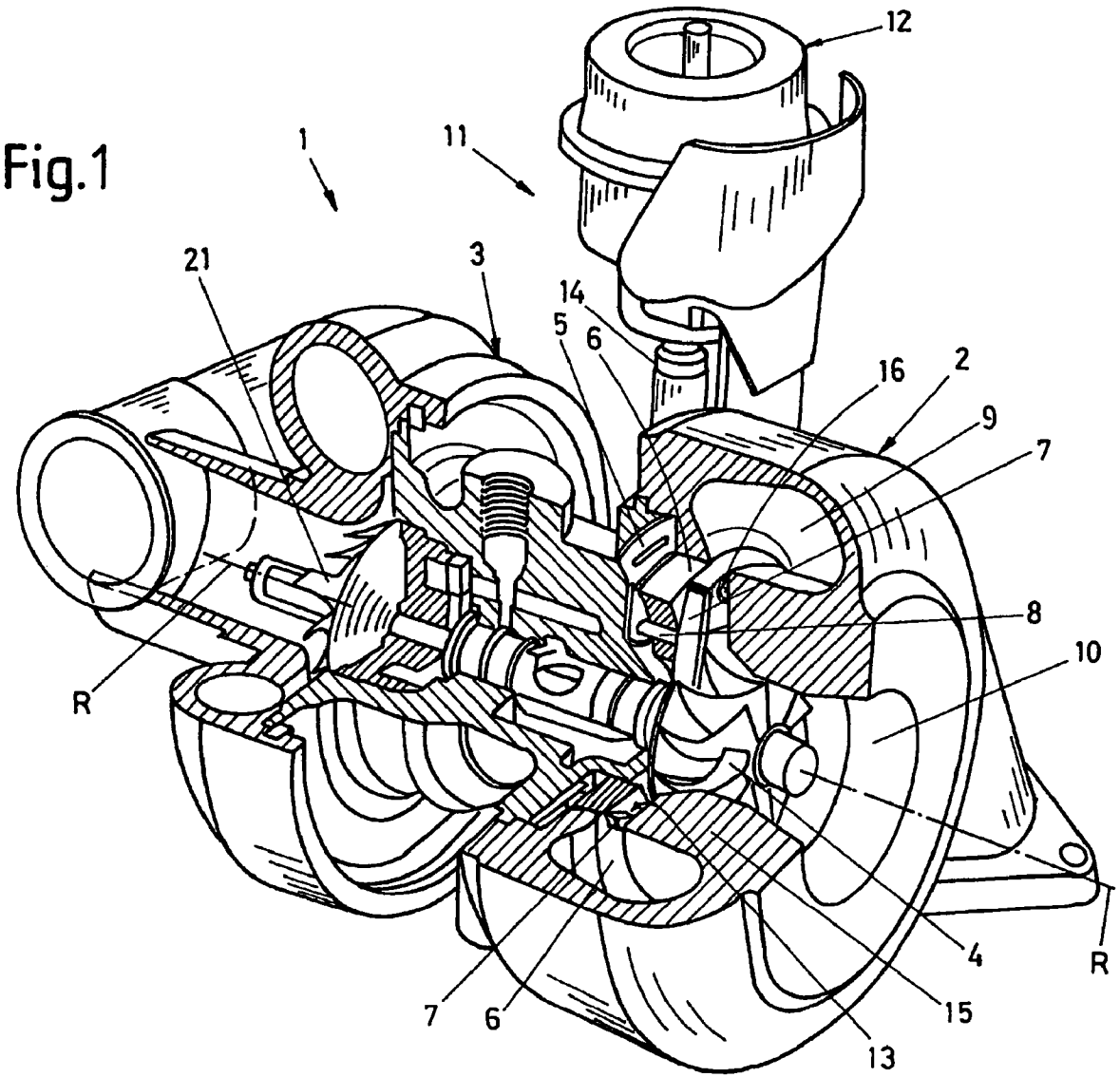
FIG. 1 is a perspective view, partially in cross-section, of a turbocharger where the invention is realized.

According to FIG. 1, a turbocharger 1 comprises in a manner known per se a turbine housing part 2 and a compressor housing part 3 connected to the turbine housing, both being arranged along an axis of rotation R. The turbine housing part 2 is shown partially in cross-section as to illustrate a vane support ring (often called "nozzle ring") carries an outer "guiding grid" of guide vanes 7 distributed over the circumference of the ring 6. These vanes may be pivoted by pivoting shafts 8 (or may be pivoted about corresponding pivoting axes) inserted into bores of the vane support ring 6. In this way, each pair of vanes form nozzles between them whose cross-section may be varied according to the pivoting position of the vanes 7, i.e. either being more radially oriented (as shown) or more tangentially, so that the cross-section is larger or smaller to supply a larger or smaller amount of exhaust gas of a combustion motor to a turbine rotor 4 situated in the middle along the axis R, the exhaust gas being introduced by a supply channel 9 and discharged through a central short feed pipe 10 to drive a compressor rotor 21 fastened to the shaft of the turbine rotor 4.

In order to control the movement or position of the guide vanes 7, an actuation device 11 is provided. This device may be of any nature desired, but it is preferred if it comprises a control housing 12, as known per se, which controls an actuation movement of a pestle member 14 accommodated in it, whose axial movement is converted in a known manner into a slight rotational movement of a control ring 5 situated just behind the vane support ring 6 (in FIG. 1 at left of it). By this rotational movement of the control ring, the rotational position of the shafts 8 of the guide vanes 7 is adjusted relative to the turbine rotor 4 in such a way that the vanes may be displaced from a substantially tangential extreme position into a substantially radially extending extreme position. In this way, a larger or smaller amount of exhaust gas of a combustion motor supplied by the supply channel 9 is fed to the turbine rotor 4, and is discharged through the axial feed pipe 10 along the rotational axis R.

Between the vane support ring 6 and a ring-shaped portion 15 of the turbine housing part 2, there is a relatively small space 13 to permit free movement of the vanes 7. Of course, this vane space 13 should not be substantially larger than the width of the vanes 7, because otherwise there would be a loss of exhaust gas energy. On the other hand, the vane space 13 should not be too small, because the vanes 7 could jam in this case. This is of particular importance, because a certain thermal expansion of the material has to be taken into account due to the hot exhaust gases.

Therefore, in order to ensure the width of this vane space 13 and the distance of the vane support ring 6 from the opposite housing ring 15, the vane support ring 6, according to the invention, has integrally formed spacers 16 formed on it and projecting from it. These spacers 16 may better be seen in FIG. 2 where the vane support ring 6 is shown without the vanes 7 supported by it.

As may be seen, the spacers 16 are arranged at equal angular distances over the circumferential surface of the ring 6 around the axis of rotation R so that the distance to the housing ring 15 (FIG. 1) is equal over the entire circumference. These spacers 16 are integrally formed with the vane support ring 6 (alternatively on the housing ring 15 or both, as has been mentioned above), preferably by a casting process, particularly by precision casting, so that they are in direct thermally conductive connection with the ring 6. It is to be understood that other manufacturing methods may also be used (as indicated above) to produce an integral part 6, 16, but a casting process is preferred.

Therefore, when hot exhaust gas flows from the supply channel 9 (or through several supply channels) to the vane space 13, heat is distributed relative quickly over the vane support ring 6 and its spacers 16 so that substantially the same thermal expansion will result all over the ring and spacers. In this way, it is ensured that the distance of the vane support ring 6 to the housing ring 15 is uniform over the entire circumference. If the spacers were formed as bushings screwed or bolted into bore holes of the ring 6, i.e. they were separate parts rather than integral ones, heat conduction would be worse and, moreover, such bushings could hardly consist of the same (e.g. cast) material so that the expansion coefficients would also be different. By the present invention, all these disadvantages are avoided, and precision and reliability in operation are enhanced.

In principle, the spacers 16 could be arranged at various locations of the radius of the vane support ring 6, but it is preferred to arrange them, as shown, at a border surface of the ring 6 (the border zone or area of the ring's circumferential surface) which contributes further to a higher spacing precision. Otherwise they have been arranged in a corresponding guiding vane as has been suggested in U.S. Pat. No. 4,659,295.

Furthermore, it has already been mentioned that it would be possible to provide at least part of the spacers 16 on the housing ring 15 to project towards the vane support ring 6. However, the conditions on the housing ring 15 are not so favorable due to the complicated three-dimensional shape of the turbine housing 2, as compared with the simple, uncomplicated shape of the vane support ring 6. Furthermore, it will be understood that it would be possible to provide only two spacers 16 or even more than three, but that with exactly three spacers 16 the connection plane to the housing ring 15 (FIG. 1) will be geometrically precisely defined. In addition, it is recommended to machine the surface 17 opposite the housing ring 15 which cooperates with housing ring 15, for example by facing, e.g. spot facing, to ensure a precise axial length of all spacers 16.

For the connection with the housing ring 15, it is advantageous to provide a bore hole 18 for connection bolts for connection with the housing ring 15 in each of the spacers 16 so that the forces exerted by the connection act directly onto the surfaces 17 of the spacers 16. Furthermore, it will be seen from FIG. 2 that the spacers 16, according to the invention, may obtain an aerodynamically favorable shape and may, in particular, be formed in the shape of a vane. In the case of an elongated shape, chosen from an aerodynamical point of view, as shown in FIG. 2, it is advantageous if this elongated shape extends substantially in tangential direction with respect to the ring 6.

Figure 2:
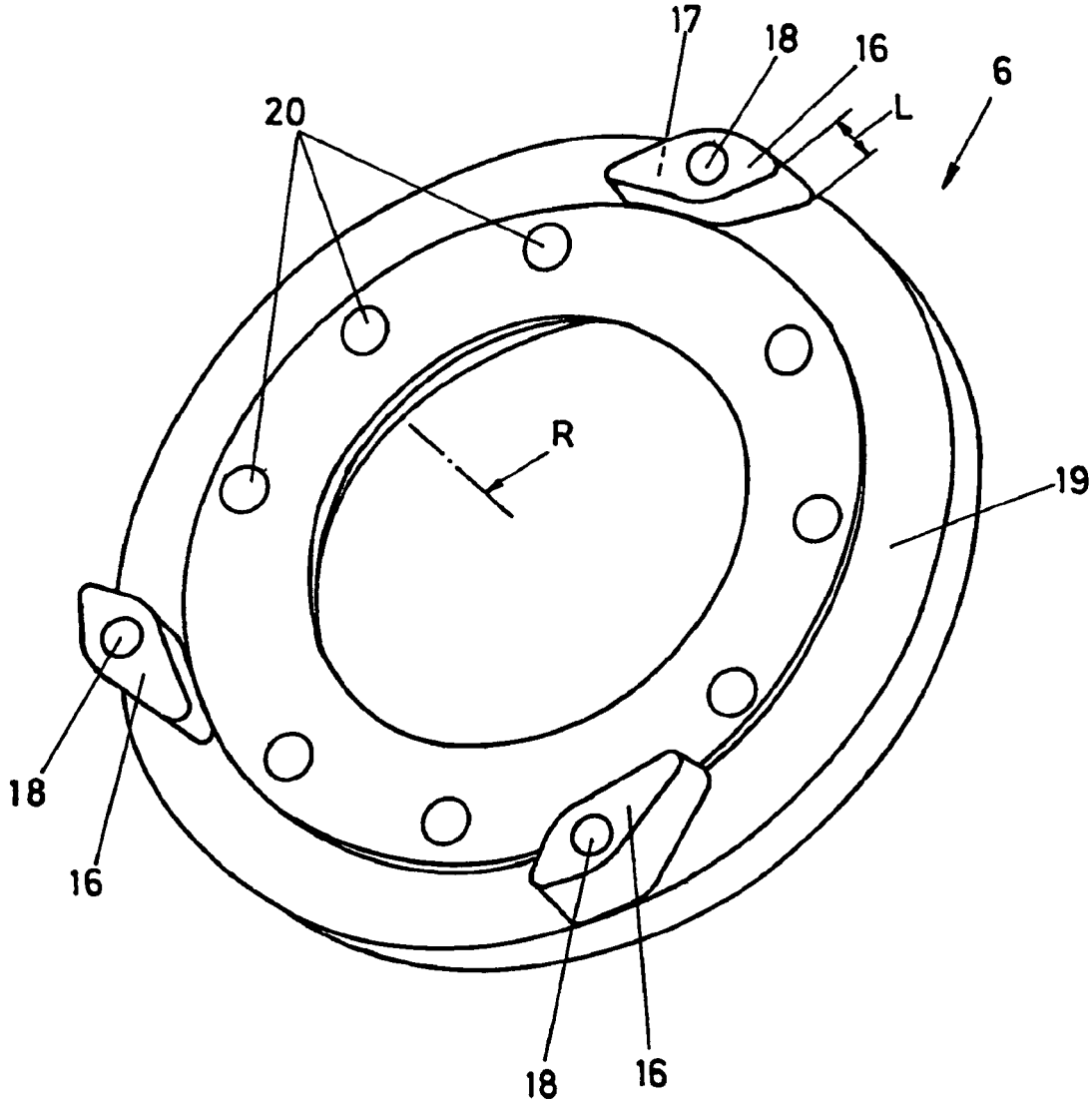
FIG. 2 is a perspective view of a vane support ring according to the invention to be inserted into the turbocharger according to FIG. 1.
Figure 3A:
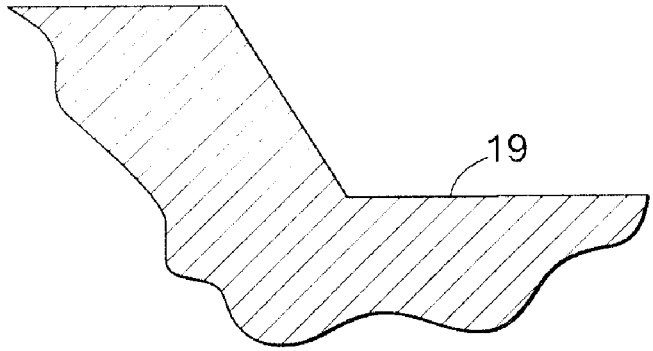
FIGS. 3*a*-3*c* show a portion of the support ring of FIG. 2.
Figure 3B:
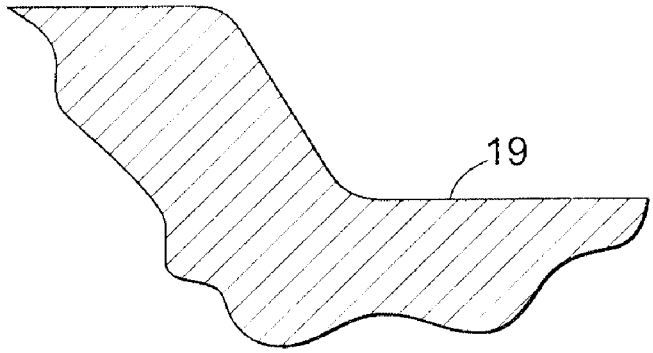
Figure 3C:
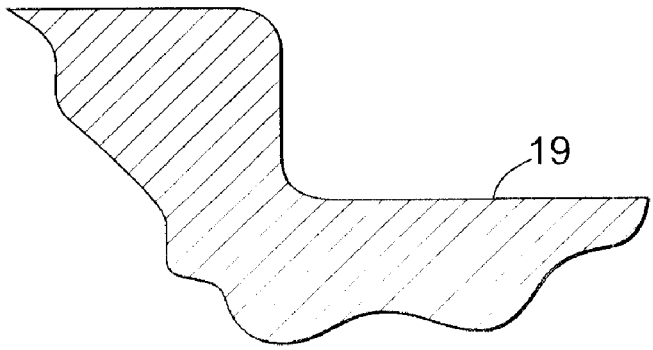

Furthermore, it is advantageous if a border area 19 of the surface of ring 15 and/or 6 is provided which shrinks back in axial direction from the vane space 13 (with reference to FIG. 2, this is the space defined by the axial length of the spacers 16). This back shrinking surface area 19 can, preferably, be gradually conically beveled, as seen in the embodiment of FIG. 2, but can, for certain applications, form a shoulder, if desired, e.g. forming a step under a rounded angle. This back shrinking area has turned out favorably for aerodynamic conditions within the vane space 13 (FIG. 1) where the vanes 7 (FIG. 1), as mentioned above, are on adjusting shafts 8 which pass each through a bore hole 20 of a ring of bore holes 20 extending in circumferential direction of the vane support ring 6. It will be understood that such an area, that shrinks back from the space 13, could also be provided on the housing ring.15, although it is preferred to have it on the vane support ring 6 only.

From the above explanation, it will be clear that both manufacturing of the spacers 16 is simplified according to the invention as well as assembling them into the turbine housing part 2. In addition, more uniform and more direct heat conduction is achieved between the respective ring, e.g. the vane support ring 6, and its integrally formed spacers 16. In this way, the reliability of precisely maintaining the axial distance or the width of the vane space 13 is enhanced in all operational conditions.

Moreover, it will be understood that the present invention is not restricted to the embodiment shown; for example it could be applied to turbochargers having more than one turbine rotor 2 and/or more than one compressor rotor 21 or more than one supply channel 9. In addition, it would be conceivable to provide not every spacer 16 with a bore hole 18, particularly if more than three spacers 16 should be provided, for example six. Instead of producing the ring, such as the vane support ring 6, together with the spacers 16 by a casting process, the surface shown in FIG. 2 could also be integrally formed by cold working, as has been suggested for other automotive components which are streamed through by a fluid.

What is claimed is:

1. A turbocharger (1) comprising:

a turbine housing part (2), vane support ring (6) carrying a guiding grid of guide vanes (7) distributed about the ring (6), the vanes being pivoted by pivoting shafts (8) inserted into bores of the vane support ring (6) such that each pair of vanes forms a nozzle between them whose cross-section is variable according to the pivoting position of the vanes (7), said turbine housing part (2) including a ring-shaped portion (15) parallel to the vane support ring (6) and defining a vane space (13) between said vane support ring (6) and said turbine housing ring-shaped portion(15), a supply channel (9) for introducing exhaust gas into said vane space (13), one or more spacers for abutting against and separating the vane support ring (6) and said turbine housing ring-shaped portion (15), wherein at least one of said vane support ring (6) and said turbine housing ring-shaped portion (15) includes a radial outer circumferential border area and a radial inner circumferential area, the radial inner circumferential area defining a first radial plane, said radial outer circumferential border area defining a second radial plane separated from the first radial plane along an axial direction and widening said vane space, wherein the one or more spacers have an aerodynamic elongated shape substantially in a tangential direction with respect to the ring member, and wherein the one or more spacers are positioned along the radial outer circumferential border area.

2. A turbocharger (1) as in claim 1, wherein a transition surface of the at least one of the vane support ring (6) and said turbine housing ring-shaped portion (15) between the radial outer circumferential border area and the radial inner circumferential area is conically beveled.

3. The turbocharger of claim 2, wherein the one or more spacers have a surface that is in proximity to the transition surface between the radial outer circumferential border area and the radial inner circumferential area.

4. A turbocharger (1) as in claim 1, wherein a transition surface of the least one of the vane support ring (6) and said turbine housing ring-shaped portion (15) between the radial outer circumferential border area and the radial inner circumferential area is a shoulder orthogonal to at least one of the radial outer circumferential border area and the radial inner circumferential area.

5. A turbocharger (1) as in claim 4, wherein said shoulder has at least one of a rounded edge and a rounded in-step.

6. The turbocharger of claim 4, wherein the one or more spacers have a surface that is in proximity to the transition surface between the radial outer circumferential border area and the radial inner circumferential area.

7. A turbocharger (1) as in claim 1, wherein the radial outer circumferential border area and the radial inner circumferential area is provided on the vane support ring (6) only.

8. A turbocharger (1) as in claim 1, wherein the radial outer circumferential border area and the radial inner circumferential area is provided on the turbine housing ring-shaped portion (15) only.

9. A turbocharger (1) as in claim 1, wherein the radial outer circumferential border area and the radial inner circumferential area is provided on both the vane support ring (6) and the turbine housing ring-shaped portion (15).

10. The turbocharger of claim 1, wherein the one or more spacers are equidistantly positioned along the radial outer circumferential border area.

11. The turbocharger of claim 1, wherein the vanes are positioned along the radial inner circumferential area.

12. The turbocharger of claim 1, wherein the one or more spacers have opposing planar surfaces.

13. The turbocharger of claim 1, wherein the one or more spacers have a surface that is substantially aligned with an outer circumference of the vane support ring.

14. The turbocharger of claim 1, wherein at least a portion of the one or more spacers has a bore hole for receiving a bolt to connect the vane support ring with the turbine housing ring-shaped portion.

* * * * *